US011539168B2

(12) United States Patent
Shiga

(10) Patent No.: US 11,539,168 B2
(45) Date of Patent: Dec. 27, 2022

(54) CONNECTOR AND CONNECTOR ASSEMBLY

(71) Applicant: Tyco Electronics Japan G.K., Kawasaki (JP)

(72) Inventor: Katsumi Shiga, Kawasaki (JP)

(73) Assignee: Tyco Electronics Japan G.K., Kawasaki (JP)

( * ) Notice: Subject to any disclaimer, the term of this patent is extended or adjusted under 35 U.S.C. 154(b) by 0 days.

(21) Appl. No.: 17/405,453

(22) Filed: Aug. 18, 2021

(65) Prior Publication Data

US 2022/0059970 A1 Feb. 24, 2022

(30) Foreign Application Priority Data

Aug. 19, 2020 (JP) ..... JP2020-138579

(51) Int. Cl.
*H01R 13/641* (2006.01)
*H01R 13/627* (2006.01)
*H01R 13/639* (2006.01)

(52) U.S. Cl.
CPC ..... *H01R 13/641* (2013.01); *H01R 13/6272* (2013.01); *H01R 13/639* (2013.01)

(58) Field of Classification Search
CPC . H01R 13/641; H01R 13/6272; H01R 13/639
See application file for complete search history.

(56) References Cited

U.S. PATENT DOCUMENTS

| | | | | |
|---|---|---|---|---|
| 10,256,569 | B2 * | 4/2019 | Ohtaka | H01R 13/6272 |
| 10,312,632 | B2 * | 6/2019 | Amemiya | H01R 13/5025 |
| 11,171,452 | B2 * | 11/2021 | Saito | H01R 13/639 |
| 2018/0034210 | A1 * | 2/2018 | Sekino | H01R 13/6272 |
| 2020/0153149 | A1 * | 5/2020 | Tanaka | H01R 13/6272 |

FOREIGN PATENT DOCUMENTS

JP 2019-057413 A 4/2019

* cited by examiner

*Primary Examiner* — Tho D Ta
(74) *Attorney, Agent, or Firm* — Barley Snyder

(57) ABSTRACT

A connector includes a housing and a connector position assurance device positioned in a temporary caught position on the housing when the connector is not mated with a mating connector. The connector position assurance device is allowed to slide to a caught position in front of the temporary caught position in a mating direction when the connector is completely mated with the mating connector. The connector position assurance device assures that the connectors are completely mated in the caught position. The connector position assurance device has a pressed-back portion abutted by the mating connector during mating and pressed back relative to the housing if the connector position assurance device is positioned in the caught position when the connector starts to mate with the mating connector, positioning the connector position assurance device in the temporary caught position at a complete mating of the connector with the mating connector.

20 Claims, 12 Drawing Sheets

CONNECTOR AND CONNECTOR ASSEMBLY

CROSS-REFERENCE TO RELATED APPLICATION

This application claims the benefit of the filing date under 35 U.S.C. § 119(a)-(d) of Japanese Patent Application No. 2020-138579, filed on Aug. 19, 2020.

FIELD OF THE INVENTION

The present invention relates to a connector and a connector assembly provided with a CPA (Connector Position Assurance).

BACKGROUND

Connectors provided with a connector position assurance device (CPA) are known. This connector position assurance device has the role of assuring that connectors are completely mated, by the fact that the connector position assurance device has moved to a certain caught position. That is, the connector position assurance device remains in a temporary caught position when the connector is not mated or is in the process of mating with a mating connector, and can be moved to the caught position only after complete mating.

In order to make the connector position assurance device assure that the connectors are completely mated, it is necessary to avoid inadvertent movement of the connector position assurance device to the certain caught position when the connectors are not mated.

Japanese Patent Application No. JP 2019-57413A discloses a connector provided with a housing having an abutting portion for abutting against a connector position assurance device positioned in a temporary caught position, thereby restraining the connector position assurance device from sliding to a caught position. Separately from the abutting portion, the housing of this connector also has an anti-sliding portion for increasing a resisting force when the connector position assurance device in the temporary caught position starts to slide toward the caught position. Further, in the case of this connector, after the connector position assurance device is pressed by a mating connector at a complete mating time and thereby the abutment against the abutting portion is removed, the connector position assurance device is pressed with a force greater than the resistance of the anti-sliding portion, thereby sliding the connector position assurance device to the caught position.

In the case of the connector in JP 2019-57413A, the connector position assurance device in the temporary caught position is restrained from sliding to the caught position by both the abutment against the abutting portion and the resisting force of the anti-sliding portion against sliding. This strongly restrains the connector position assurance device from moving inadvertently to the caught position when the connectors are not mated, as compared with a structure that restrains the connector position assurance device from sliding to the caught position only by the abutment against the abutting portion. No matter how strongly the connector position assurance device is restrained, however, the possibility that the connector position assurance device may move inadvertently to the caught position when the connectors are not mated cannot completely be eliminated by this arrangement.

SUMMARY

A connector includes a housing and a connector position assurance device positioned in a temporary caught position on the housing when the connector is not mated with a mating connector. The connector position assurance device is allowed to slide to a caught position in front of the temporary caught position in a mating direction when the connector is completely mated with the mating connector. The connector position assurance device assures that the connectors are completely mated in the caught position. The connector position assurance device has a pressed-back portion abutted by the mating connector during mating and pressed back relative to the housing if the connector position assurance device is positioned in the caught position when the connector starts to mate with the mating connector, positioning the connector position assurance device in the temporary caught position at a complete mating of the connector with the mating connector.

BRIEF DESCRIPTION OF DRAWINGS

The invention will now be described by way of example with reference to the accompanying Figures, of which.

DETAILED DESCRIPTION OF THE EMBODIMENT(S)

Figures 1A, 1B, 1C:
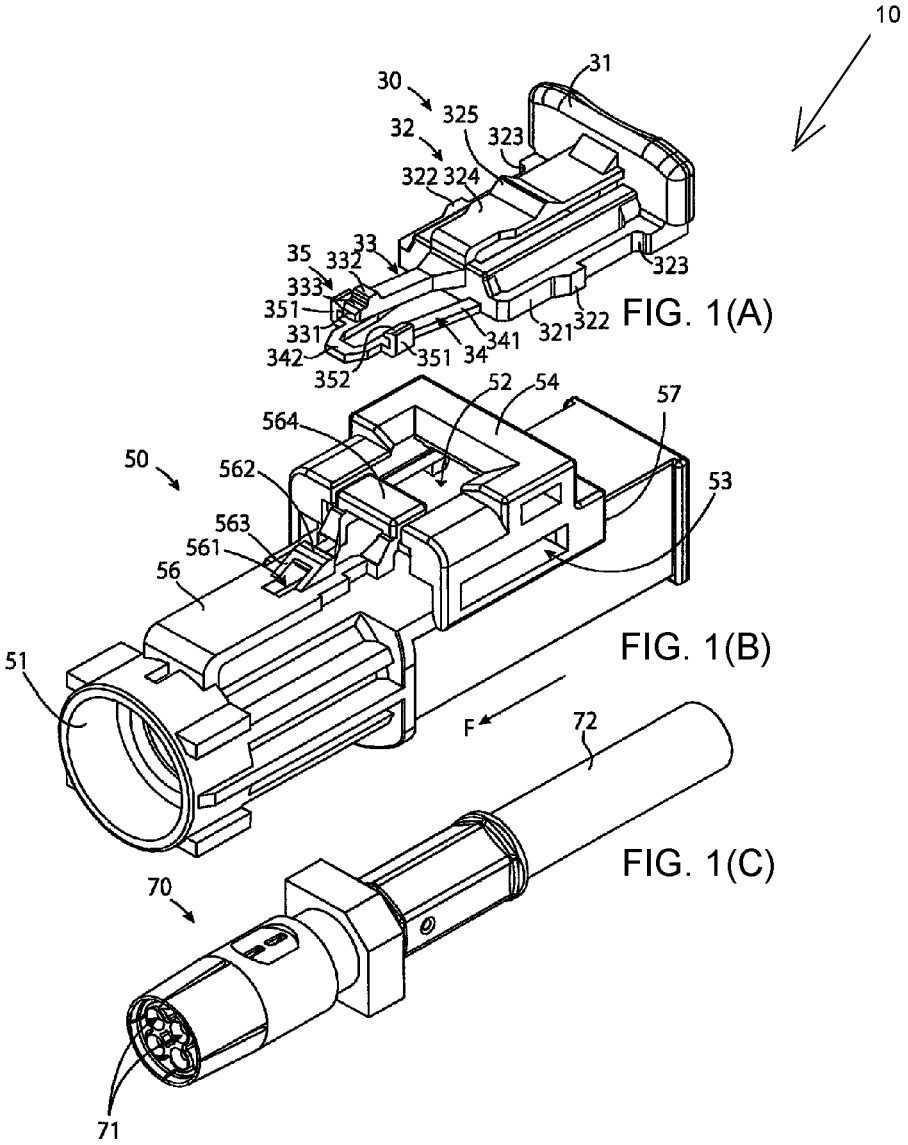
FIG. 1(A) is a perspective view of a connector position assurance device of a first connector according to an embodiment.
FIG. 1(B) is a perspective view of a first housing of the first connector.
FIG. 1(C) is a perspective view of a first contact module of the first connector.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art. Furthermore, several aspects of the embodiments may form—individually or in different combinations—solutions according to the present invention. The following described embodiments thus can be considered either alone or in an arbitrary combination thereof.

A first connector 10 according to an embodiment is shown in FIGS. 1(A)-1(C). The first connector 10 is an embodiment of a connector of the present invention, and is also an embodiment of a first connector referred to in a connector assembly of the present invention. The connector 10 shown in FIGS. 1(A)-1(C) is referred to as first connector 10 for the purpose of discrimination from a connector shown in FIGS. 7(A)-7(C) (second connector 90) to be mated with this connector 10. The same applies to an element that constitutes the first connector 10 and whose corresponding element also exists in the second connector 90.

The first connector 10 is provided with a CPA 30 shown in FIG. 1(A), a first housing 50 shown in FIG. 1(B), and a first contact module 70 shown in FIG. 1(C). The CPA 30 is supported by the first housing 50, and slides on the first housing 50 between a temporary caught position described later and a caught position in front of the temporary caught position in a mating direction indicated by an arrow F. The first housing 50 supports the CPA 30 and simultaneously retains the first contact module 70. The first contact module 70 has a female contact 71. Further, the female contact 71 is connected with a cable 72.

Figure 2B:
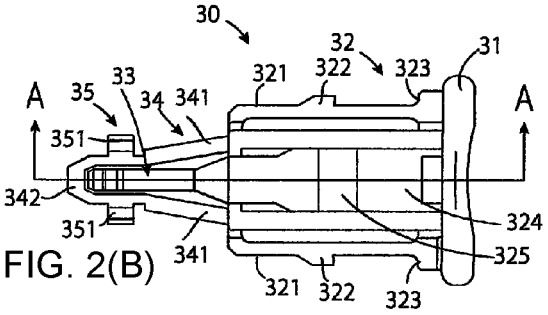
FIG. 2(B) is a top view of the connector position assurance.
Figure 2A:
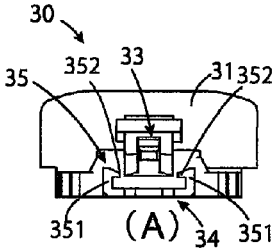
FIG. 2(A) is a front view of the connector position assurance.
Figure 2C:
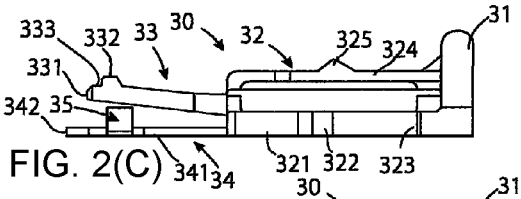
FIG. 2(C) is a side view of the connector position assurance.
Figure 2D:
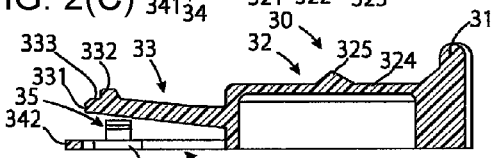
FIG. 2(D) is a sectional side view of the connector position assurance, taken along arrows A-A of FIG. 2(B)

FIG. 2(A) is a front view of the CPA 30, FIG. 2(B) is a top view thereof, FIG. 2(C) is a side view thereof, and FIG. 2(D) is a cross-sectional view thereof taken along arrows A-A shown in FIG. 2(B).

The CPA 30, as shown in FIGS. 1(A) and 2(A)-2(D) has an operative portion 31, a base portion 32, a beam portion 33, an arm portion 34, and a pressed-back portion 35. The operative portion 31 is a portion operated by a user. This operative portion 31 also has a role as an indicator for indicating whether or not the CPA 30 is in the caught position that assures that the connectors are completely mated, through visual confirmation of the position of the operative portion 31.

The base portion 32 is a portion which is supported by a housing 50 of the first connector 10, and via which sliding of the CPA 30 is guided. A beam 321 in the shape of a double-fixed beam extending in a sliding direction (the direction of the arrow F) and fixed at both ends is provided on the left and right of this base portion 32, as shown in FIG. 2(B). Further, a temporary caught projection 322 projecting laterally outward is formed in the vicinity of a center of the beam 321 in the sliding direction. This temporary caught projection 332 has an inclined face formed on its front side in the mating direction (the direction of the arrow F), and has a substantially vertical wall face on its rear side. In addition, an expanded portion 323 projecting laterally outward is formed at a rear end portion of the beam 321 in the sliding direction.

As shown in FIGS. 1(A) and 2(A)-2(D), a beam 324 in the shape of a double-fixed beam extending in the sliding direction (the direction of the arrow F) and fixed at both ends is also provided in a widthwise central portion of the base portion 32. A projecting portion 325 projecting upward and substantially triangular in cross section in the sliding direction is also formed on this central beam 324 in the vicinity of its center in the sliding direction.

The beam portion 33 of this CPA 30 extends in the shape of a cantilever in a forward direction indicated by the arrow F and diagonally upward from the base portion 32, as shown in FIGS. 2(C) and 2(D). An abutting projection 332 projecting upward is formed in a position slightly closer to the base portion 32 than a distal end 331 of this beam portion 33. Further, since this abutting projection 332 is formed in the position slightly closer to the base portion 32 than the distal end 331, a stepped portion 333 is formed on the beam portion 33 between the distal end 331 and the abutting projection 332. The actions of the temporary caught projection 322, the projecting portion 325, the abutting projection 332, and the like will be described later.

The CPA 30 is provided with the arm portion 34 and the pressed-back portion 35, as shown in FIGS. 1(A) and 2(A)-2(D). The arm portion 34 is composed of two extending portions 341 and a connecting portion 342. The two extending portions 341 extend, with a gap therebetween, forward in the mating direction indicated by the arrow F from the base portion 32. In addition, the connecting portion 342 connects distal end portions of these two extending portions 341 together.

The gap between the two extending portions 341 is a gap having a width for receiving the beam portion 33 elastically deformed in a manner described later. This achieves miniaturization of the CPA 30, and consequently, miniaturization of the first connector 10, as compared with a case where the gap cannot receive the beam portion 33. The beam portion 33 elastically deformed can be received in the gap, and therefore the size of the CPA 30, and consequently the size of the connector 10, can be reduced as compared with a case where the beam portion 33 cannot be received therein.

The pressed-back portion 35 is composed of a pair of hook portions 351 formed individually on each of the two extending portions 341. These hook portions 351 have a gap therebetween, and is rising toward a lock arm portion 56 positioned thereabove when the CPA 30 is supported on the first housing 50. Further, these hook portions 351 have projecting portions 352 projecting toward each other at their raised distal end portions. These hook portions 351 are pressed apart by interference of the lock arm portion 56 pressed and elastically deformed by the second connector 90 at the mating time with the projecting portions 352. This causes these hook portions 351 to advance into a path of the second connector 90 with respect to the mating direction (direction of the arrow F). This motion will be described later with reference to the drawings.

If the pressing-back portion 35 is provided in the base portion 32, and that the pressing-back portion 35 is positioned in a suitable position, the base portion 32 may be increased in size, which may in turn increase the size of the entire connector 10. By providing the arm portion 34 in the above manner and forming the pressed-back portion 35 on the arm portion 34, however, an increase in the size of the base portion 32 can be avoided, and simultaneously the pressed-back portion 35 can be formed in a suitable position.

Figure 3A:
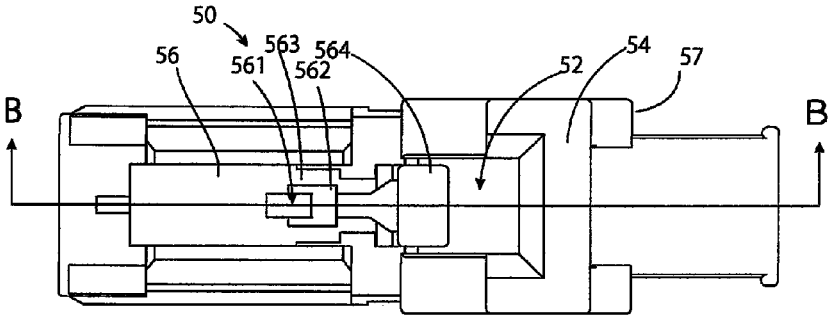
FIG. 3(A) is a top view of the first housing.
Figure 3B:
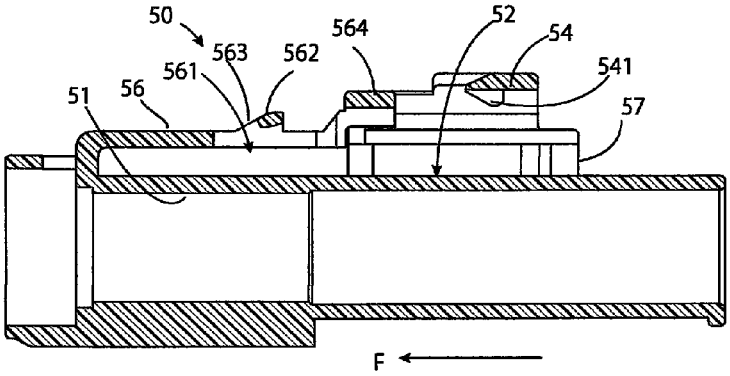
FIG. 3(B) is a sectional side view of the first housing, taken along arrows B-B of FIG. 3(A)

FIG. 3(A) is a top view of the first housing 50, and FIG. 3(B) is a cross-sectional view thereof taken along arrows B-B shown in FIG. 3(A).

An accommodating portion 51 for accommodating the first contact module 70 is provided in the first housing 50, as shown in FIGS. 1(B) and 3(B). Further, a supporting face 52 on which the CPA 30 is supported is formed on the accommodating portion 51. An opening portion 53, shown in FIG. 1(B), opened outward is formed on both left and right sides of this supporting face 52.

The first housing 50 has a gate portion 54 and the lock arm portion 56. The gate portion 54 is separated from the supporting face 52 on which the CPA 30 is supported so that an opening is formed between the gate portion 54 and the supporting face 52, and the gate portion 54 is so formed as to span the supporting face 52 leftward and rightward. The CPA 30 is so supported on the supporting face 52 as to get into the opening formed between the supporting face 52 and the gate portion 54.

A downward-extending portion 541 projecting downward is formed on the gate portion 54, as shown in FIG. 3(B). The action of the downward-extending portion will be described later.

The lock arm portion 56 extends in the shape of a cantilever from front to rear in the mating direction indicated by the arrow F. In this lock arm portion 56, a lock groove 561 is formed on a distal end side (a rear side in the mating direction indicated by the arrow F) of the cantilever-shaped extension. Further, on this lock arm portion 56, an abutting portion 562 is so provided as to span the lock groove 561 from side to side. On a fixed end side (a front side in the mating direction indicated by the arrow F) of this abutting portion 562, an inclined face 563 descending toward the fixed end side is formed. The abutting portion 562 of this lock arm portion 56 abuts against the beam portion 33 of the CPA 30 in the temporary caught position, thereby blocking movement of the CPA 30 to the caught position. Further, when the first connector 10 is mated with the second connector 90, the abutting portion 562 is pressed and elastically deformed by the second connector 90, thereby removing the abutment against the beam portion 33. This allows the CPA 30 to move to the caught position. The details will be described later with reference to the drawings.

As shown in FIGS. 1(B), 3(A), and 3(B), an operative portion 564 is formed at a distal end portion of this lock arm portion 56. This operative portion 564 is operated when the first connector 10 and the second connector 90 mated together are unmated from each other.

Figure 4:
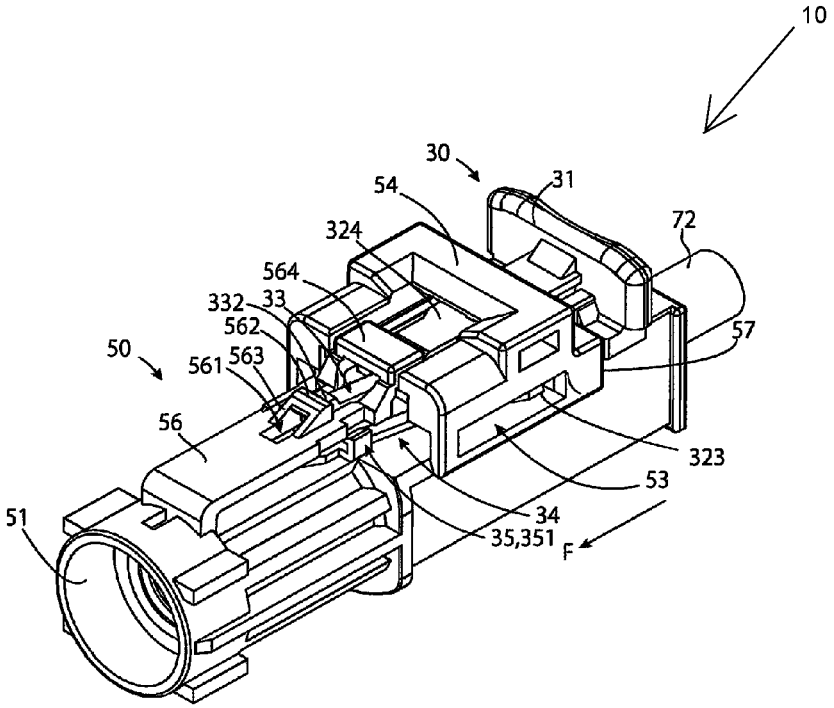
FIG. 4 is a perspective view of the first connector in an assembled state.
Figure 5A:
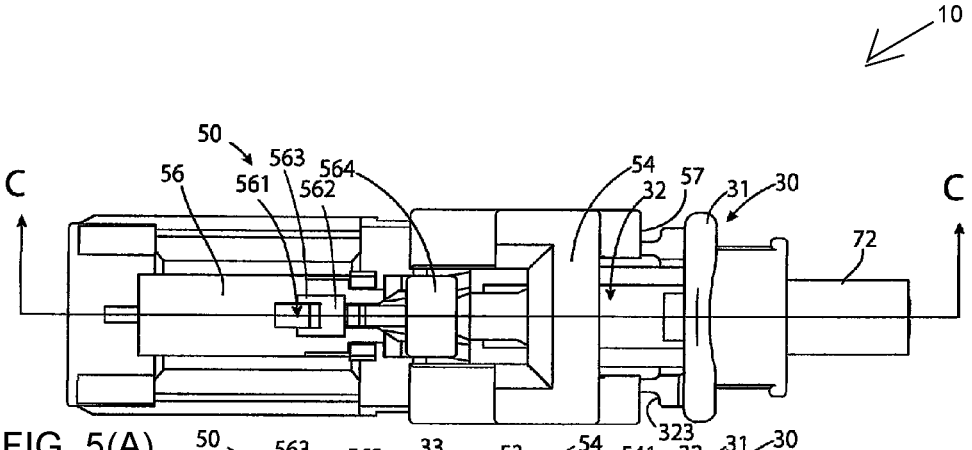
FIG. 5(A) is a top view of the first connector in the assembled state.

FIG. 4 is an isometric view of the first connector 10 in an assembled state. FIG. 5(A) is a top view of the first connector 10 in the state whose isometric view is shown in FIG. 4, FIG. 5(B) is a side view thereof, and FIG. 5(C) is a cross-sectional view thereof taken along arrows C-C shown in FIG. 5(A).

The first contact module 70 is accommodated in the accommodating portion 51 of the first housing 50. In addition, the CPA 30 is placed on the supporting face 52 (see FIG. 1(B)) of this first housing 50. That is, this CPA 30 is inserted into the opening below the gate portion 54 from behind in the mating direction indicated by the arrow F, with the beam portion 33 and the pressed-back portion 35 of the CPA 30 oriented forward, and furthermore the CPA 30 is placed on the supporting face 52 with the beam portion 33 under the operative portion 564. The temporary caught projection 322 is formed on the beam 321 on both sides of the CPA 30. When the CPA 30 is inserted into the gate portion 54, the inclined face of the temporary caught projection 332 contacts a wall face on both sides of the entrance opening of the gate portion 54 and the beam 321 deflects, and thereby the CPA 30 passes through the entrance opening. Further, in FIG. 4, the abutting projection 332 in the vicinity of the distal end of the beam portion 33 of the CPA 30 abuts against the abutting portion 562 of the lock arm portion 56 of the housing 50. A position shown in FIGS. 4 and 5(A)-5(C) of the CPA 30 when the abutting projection 332 abuts against the abutting portion 562 is the temporary caught position.

Figure 5B:
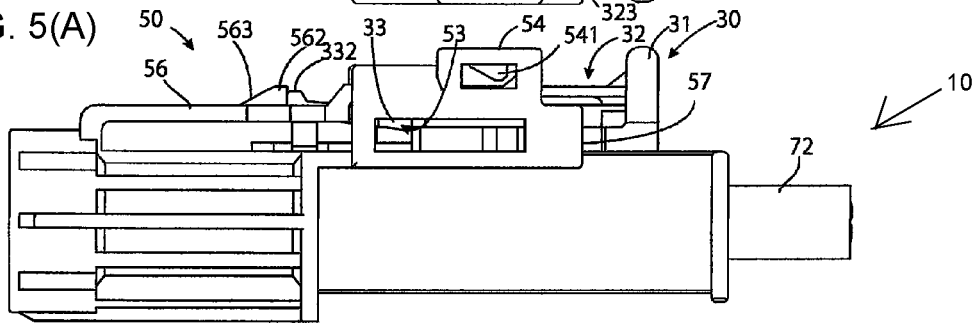
FIG. 5(B) is a side view of the first connector in the assembled state.
Figure 5C:
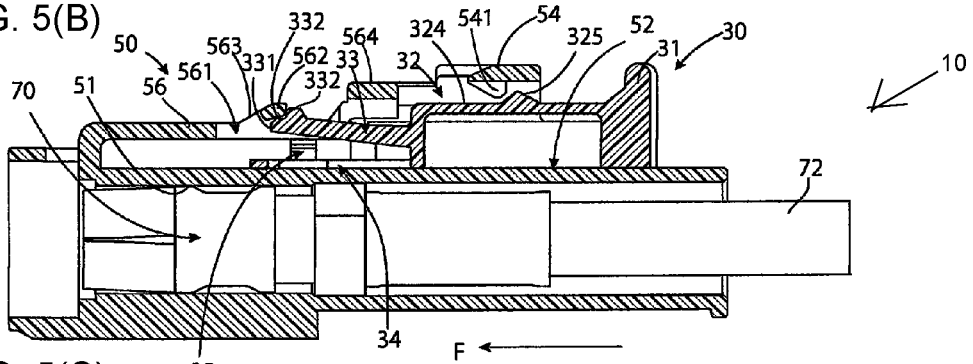
FIG. 5(C) is a sectional side view of the first connector in the assembled state, taken along arrows C-C of FIG. 5(A)

When the CPA 30 is located in this temporary caught position, the downward-extending portion 541 and provided on the gate portion 54 and projecting downward is located immediately in front of the projecting portion 325 provided on the base portion 32 of the CPA 30 and projecting upward, as shown in FIG. 5(C). This downward-extending portion 541 acts as a resistance to sliding of the CPA 30 in the forward direction (the direction of the arrow F) from the temporary caught position shown here.

The abutting projection 332 of the beam portion 33 of the CPA 30 abuts against the abutting portion 562 of the housing 20, as shown in FIGS. 5(A)-5(C), thereby blocking the CPA 30 from sliding forward (in the direction of the arrow F). The beam portion 33 of the CPA 30, however, has a forward elongated shape. Now assume that a structure which blocks the CPA 30 from sliding only by abutting the abutting projection 332 against the abutting portion 562 is employed. In that case, when the operative portion 31 is pressed with a strong force, the beam portion 33 may be unable to bear the force and may deflect, which may cause the CPA 30 to slide even in an unmated state. Therefore, in the present embodiment, when the CPA 30 in the temporary caught position is pressed, the interference between the projection portion 325 and the downward-extending portion 541 acts as a resistance to keep the CPA 30 in the temporary caught position. However, taking into account the possibility that the CPA 30 nevertheless may slide, the present embodiment is provided with a structure in which, even in such a case, the connectors are correctly mated, and the CPA 30 assures their complete mating. The details will be described later.

When the CPA 30 is in the temporary caught position, the temporary caught projection 322 provided on the beam 321 on both sides of the base portion 32 of the CPA 30 is in the opening portion 53 on both left and right sides of the supporting face 52 of the housing 50. When a force in an extracting direction (the opposite direction to the arrow F) is applied to the CPA 30 in this state, the sheer rear wall face of the temporary caught projection 322 hits against a rear wall of the opening portion 53. This blocks extraction of the CPA 30, and the CPA 30 is kept in the temporary caught position.

Figure 6:
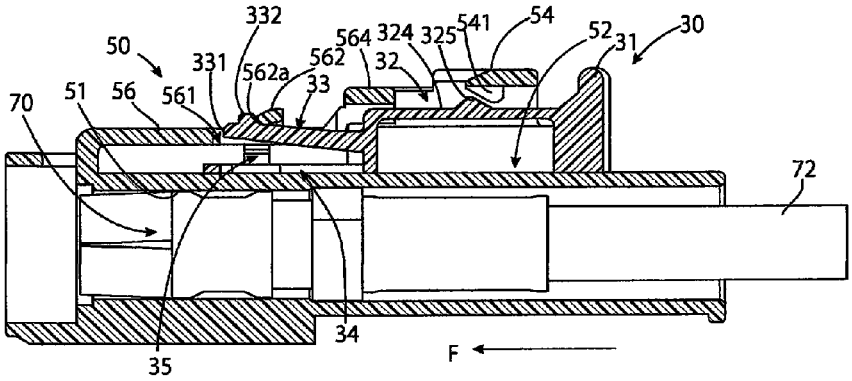
FIG. 6 is a sectional side view of the first connector with the connector position assurance slid to a caught position.

FIG. 6 is a cross-sectional view similar to FIG. 5(C) of the first connector 10 with the CPA 30 slid to the caught position. In FIG. 6, the abutting projection 332 provided on the beam portion 33 is located in front of the abutting portion 562 of the lock arm portion 56. This position of the CPA 30 is the caught position. When the CPA 30 is located in this caught position, the abutting projection 332 is caught on a front end wall 562*a* of the abutting portion 562. That is, this front end wall 562*a* is equivalent to an example of a catching portion defined in the present invention.

When the CPA 30 is positioned in this caught position, the expanded portion 323 provided on the base portion 32 of the CPA 30 hits against a vertical wall 57 of the first housing 50. This blocks the CPA 30 from moving forward beyond the caught position. In addition, when the CPA 30 slides from the temporary caught position to the caught position, the projection portion 325 gets beyond the downward-extending portion 541 of the gate portion 54, and, in the caught position, the projection portion 325 is located in front of the downward-extending portion 541.

The CPA 30, essentially, is slidable to the caught position shown in FIG. 6 only when the first connector 10 and the second connector 90 are completely mated. As described above, the CPA 30 in the temporary caught position is kept in the temporary caught position doubly by the abutment of the abutting projection 332 against the abutting portion 562 and the interference of the abutting portion 325 with the downward-extending portion 541 when the connectors are not mated. Nevertheless, it occasionally happens that the CPA 30 slides to the mating position shown in FIG. 6 when the connectors are not mated. The present embodiment is provided with a recovery device for the case where the CPA 30 has slid to the mating position shown in FIG. 6 before the mating.

Figures 7A, 7B, 7C:
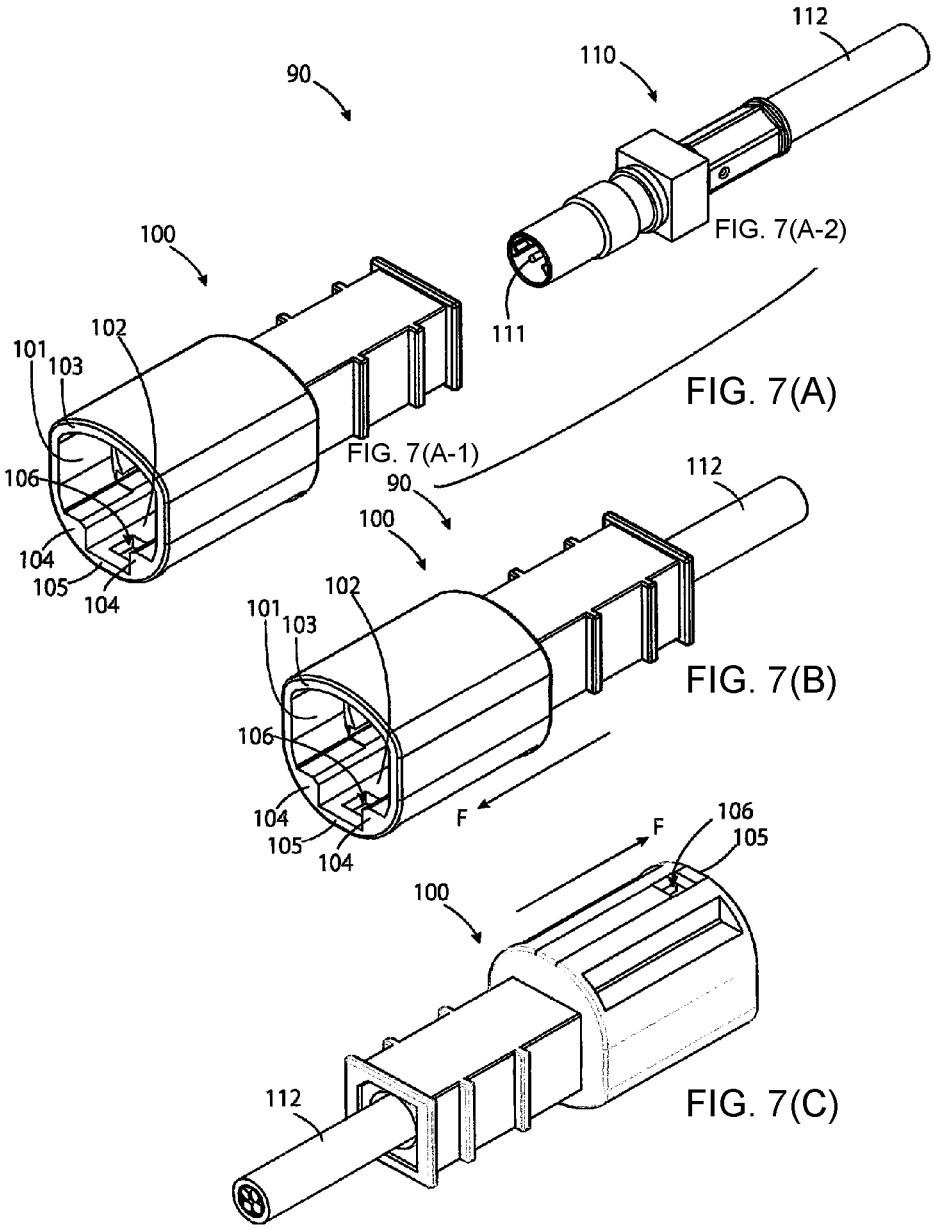
FIG. 7(A) is an exploded perspective view of a second housing and a second contact module of a second connector.
FIG. 7(B) is a front perspective view of the second housing assembled with the second contact module.
FIG. 7(C) is a rear perspective view of the second housing assembled with the second contact module.
Figure 8A:
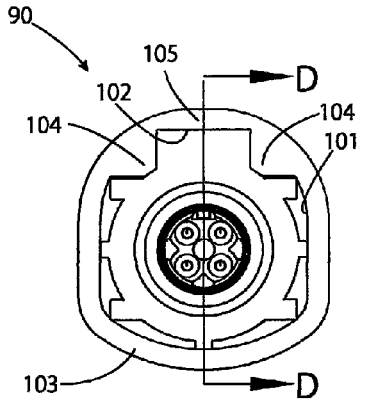
FIG. 8(A) is a top view of the second connector.
Figure 8B:
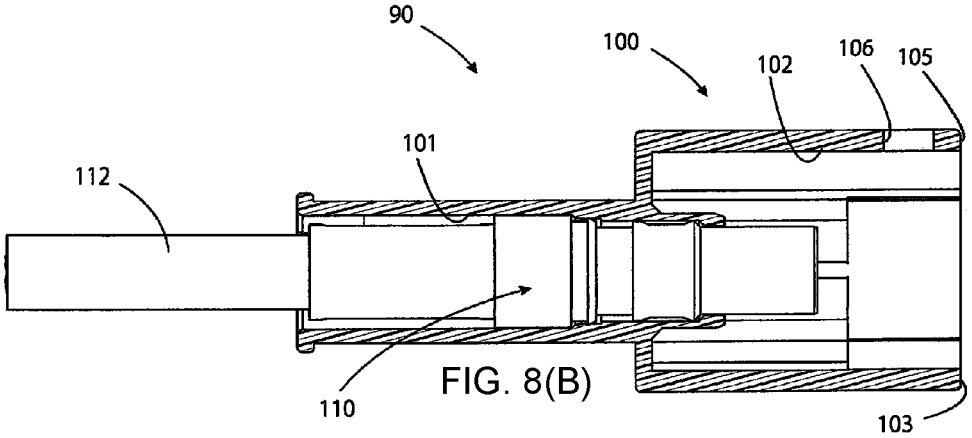
FIG. 8(B) is a sectional side view of the second connector, taken along arrows D-D of FIG. 8(A)

FIG. 7(A) is an exploded isometric view of the second connector 90 constituting a connector assembly as an embodiment of the present invention, and FIGS. 7(B) and 7(C) are isometric views thereof from different angles from each other. In addition, FIG. 8(A) is a front view of the second connector 90, and FIG. 8(B) is a cross-sectional view thereof taken along arrows D-D shown in FIG. 8(A).

This second connector 90 is equivalent to an example of a second connector referred to in the connector assembly of the present invention, and is also equivalent to an example of a mating connector referred to in the connector of the present invention.

The second connector 90 is composed of a second housing 100 shown in FIG. 7(A-1), and a second contact module 110 shown in FIG. 7(A-2). The second contact module 110 is provided with a male contact 111. Further, this male contact 111 is connected with a cable 112. When the first connector 10 shown in FIGS. 1(A)-1(C) and this second connector 90 are mated, this male contact 111 is inserted into the female contact 71 of the first connector 10, and the male contact 111 and the female contact 71 become electrically connected to each other.

The second housing 100 shown in FIG. 7(A-1) is formed with an accommodating portion 101 for accommodating the second contact module 110. This accommodating portion 101 not only accommodates the second contact module 110, but also has the following shape required when the second connector 90 is mated with the first connector 10. That is, this accommodating portion 101 is formed with a groove 102 for accommodating the lock arm portion 56 of the first housing 50. The accommodating portion 101 and the groove 102 extend to a mating-side end face 103 of this second housing 100. Further, both sides of the groove 102 of the mating-side end face 103 form a pressing-back portion 104 for pressing back the CPA 30 by hitting against the pressed-back portion 35 (a pair of hook portions 352) in a manner described later. In addition, a portion corresponding to the groove 102 of the end face 103 forms an abutment removing portion 105 for removing abutment between the abutting projection 332 of the beam portion 33 of the CPA 30 and the abutting portion 562 of the lock arm 56.

Furthermore, in this second housing 100, a lock hole 106 for receiving the abutting projection 332 of the CPA 30 in the caught position and retaining the CPA 30 in the caught position is formed in a position inside the groove 102 and slightly back from the abutment removing portion 105 of the mating-side end face 103.

Figure 9A:
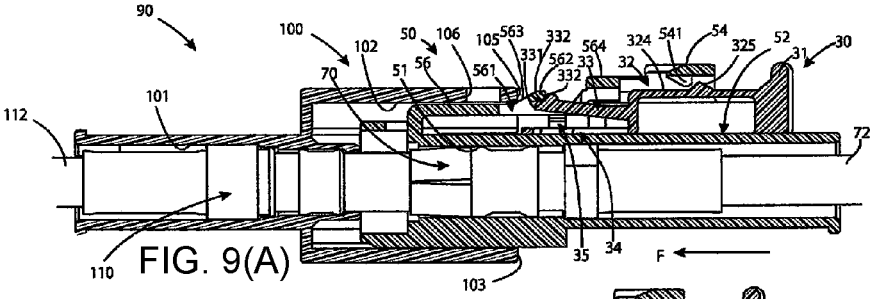
FIG. 9(A) is a sectional side view of the first connector and the second connector in a process of mating, with the connector position assurance in a temporary caught position.
Figure 9B:
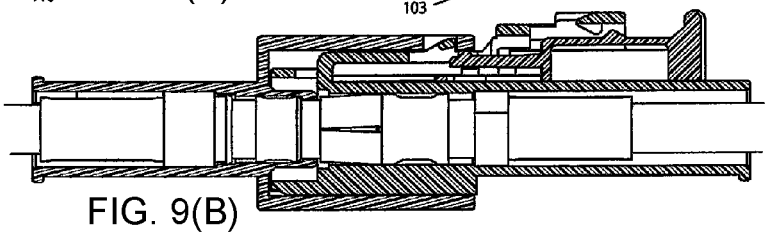
FIG. 9(B) is a sectional side view of the first connector and the second connector completely mated.
Figure 9C:
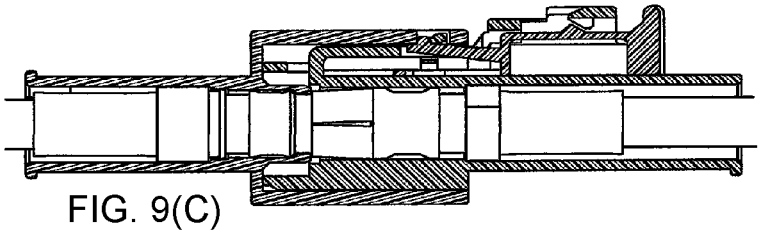
FIG. 9(C) is a sectional side view of the first connector and the second connector in a state in which the connector position assurance is slid to a caught position.

FIGS. 9(A)-9(C) are cross-sectional views sequentially showing how the first and second connectors 10, 90 are mated when the CPA 30 is in the temporary caught position.

The cross-section of the first connector 10 taken along the arrows C-C shown in FIG. 5(A) and the cross-section thereof taken along the arrows D-D in FIG. 8(A) are shown in FIGS. 9(A)-9(C). With advance of mating, however, each member moves or elastically deforms, and therefore FIGS. 9(A)-9(C) do not depict the cross-sections of FIGS. 5(A) and 8(A) as they are, but depict movement or elastic deformation of each member involved in advance of mating.

In order for mating, the first connector 10 moves relative to the second connector 90 in the mating direction indicated by the arrow F. Since the movement of the first connector 10 and the second connector 90 in the mating direction indicated by the arrow F is a relative movement, description will be made here on the assumption that the second connector 90 is fixed, and the first connector 10 is moved in the mating direction (the direction of the arrow F).

FIG. 9(A) is a diagram showing a state in the process of mating and immediately after the second housing 100 contacts the abutting portion 562 of the lock arm portion 56 of the first housing 50. Here, the abutment removing portion 105 of the end face 103 on the first housing 50 side (an end face oriented in the opposite direction to the arrow F) of the second housing 100 contacts the inclined face 563 of the abutting portion 562 of the lock arm portion 56. The abutment removing portion 105, however, does not still apply a force to the abutting portion 56. Here, the CPA 30 is in the temporary caught position, and the abutting projection 332 of the beam portion 33 of the CPA 30 abuts against the abutting portion 562 of the lock arm portion 56. In addition, at this time, the projecting portion 325 of the CPA 30 is located behind (behind in the mating direction indicated by the arrow F) the downward-extending portion 541 formed in the gate portion 54 of the first housing 50.

Figure 12A:
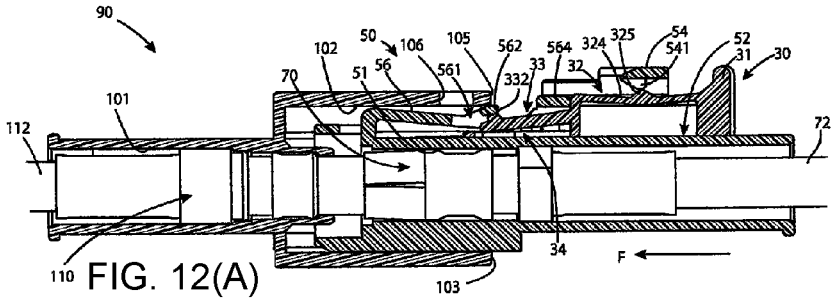
FIG. 12(A) is a sectional side view of the first connector and the second connector in a state in which mating has further advanced from FIGS. 11(A)-11(C)
Figure 12B:
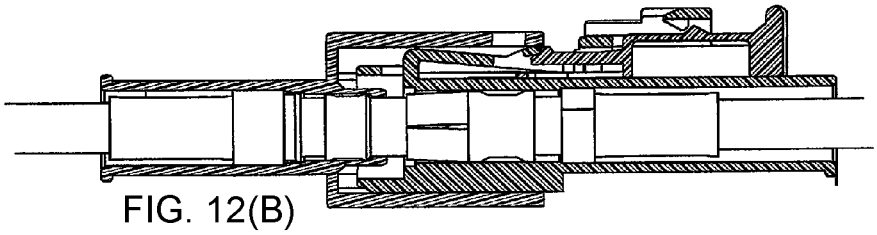
FIG. 12(B) is a sectional side view of the first connector and the second connector in a state in which mating has further advanced from FIG. 12(A)

Thereafter, when the first connector 10 is further moved in the mating direction (the direction of the arrow F), the abutment removing portion 105 presses the inclined face 563, and thereby the lock arm portion 56 is depressed and elastically deformed, for example as shown in FIGS. 12(A) and 12(B). Reference to FIGS. 12(A) and 12(B) here, however, is only for the purpose of description of depression and elastic deformation of the lock arm portion 56, and FIGS. 12(A) and 12(B) are different in the position of the CPA 30 from FIG. 9(A). With the CPA 30 in the temporary caught position shown in FIG. 9(A), when the lock arm portion 56 is depressed, the beam portion 33 is depressed by the abutting portion 562 of the lock arm portion 56, and the beam portion 33 is also elastically deformed.

Then, with the lock arm portion 56 and the beam portion 33 depressed and elastically deformed, the first connector 10 is further moved in the mating direction (the direction of the arrow F). Thereupon, as shown in FIG. 9(B), the abutment removing portion 105 gets beyond the abutting portion 562, and the abutting portion 562 enters the lock hole 106 of the second housing 100. At this time, the lock arm portion is relieved from elastic deformation and returns to its original shape. On the other hand, the abutting projection 332 of the beam portion 33 of the CPA 30 is next depressed by the second housing 100, and the beam portion 33 remains elastically deformed. This removes the abutment of the abutting projection 332 against the abutting portion 562. This abutment removal enables the CPA 30 to slide in the mating direction (the direction of the arrows F). In addition, at this time, the mating between the first connector 10 and the second connector 90 has reached a final stage, and the connectors are completely mated.

After reaching the completely-mated state shown in FIG. 9(B), only the CPA 30 is next pressed in the mating direction (the direction of the arrow F) with a force only enough to overcome the interference between the projecting portion 325 and the downward-extending portion 541. Thereupon, the beam 324 at the widthwise central portion of the base portion 32 of the CPA 30 deflects once, and the projecting portion 325 of the CPA 30 gets beyond the downward-extending portion 541, as shown in FIG. 9(C). At this time, a click feel is given to the user. In addition, at this time, the abutting projection 332 of the beam portion 33 of the CPA 30 enters the lock hole 106 of the second housing 100 in front (front in the direction of the arrow F) of the abutting portion 562 of the lock arm 56, and is caught between the abutting projection 332 and the second housing 100. Thereby, sliding of the CPA 30 to the caught position is completed. Further, the fact that the CPA 30 is in this caught position assures complete mating.

When the CPA 30 is in the caught position shown in FIG. 9(C), a part of the base portion 32 of the CPA 30 is located immediately below the operative portion 564 of the first housing 50. This prevents the operative portion 564 from being depressed, so that the first connector 10 and the second connector 90 cannot be unmated, and the completely-mated state is kept.

In order to unmate the first connector 10 and the second connector 90 from each other, the CPA 30 in the caught position in FIG. 9(C) is pulled back to the temporary caught position shown in FIG. 9(B) in the opposite direction to the mating direction (the direction of the arrow F). Thereupon, a space is created under the operative portion 564, and the operative portion 564 becomes able to be depressed.

In this state, the operative portion 564 is depressed. Thereupon, with that depression, the abutting portion 562 that has entered the lock hole 106 of the second housing 100 is also depressed to release the lock of the abutting portion 562 in the second housing 100.

Then, with the lock released, namely, with the operative portion 564 depressed, a force in an unmating direction (the opposite direction to the arrow F) is applied to the entire first connector 10. By doing so, the first connector 10 is extracted from the second connector 90, and they are unmated.

It should be noted that, in the above description, when mating is performed, the CPA 30 is slid to the caught position after the connectors 10, 90 are mated into a completely-mated state shown in FIG. 9(B), but these may be performed substantially simultaneously. That is, the connectors 10, 90 are mated while the CPA 30 is pressed in the mating direction at an early stage of mating. Thereupon, first, the connectors 10, 90 are completely mated, and immediately thereafter the CPA 30 slides to the caught position.

Next, a case where mating starts with the CPA 30 moved to the caught position, as shown in FIG. 6, will be described. FIGS. 10(A)-10(D) are diagrams showing a state at an early stage of mating in which the lock arm portion 56 is still not depressed.

Figure 10A:
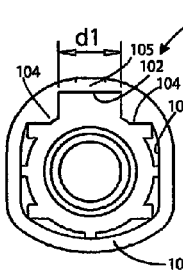
FIG. 10(A) is a front view of a front end face of a second housing of the second connector in a state at an initial stage of mating in which a lock arm portion is still not depressed at an initial stage of mating.

FIG. 10(A) is a diagram showing the shape of the front end face of the second housing 100. The accommodating portion 101, the groove 102, the pressing-back portion 104 on both sides of the groove 102, and the abutment removing portion 105 are shown here. Here, the width of the groove 102 is denoted by d1.

Figure 10B:
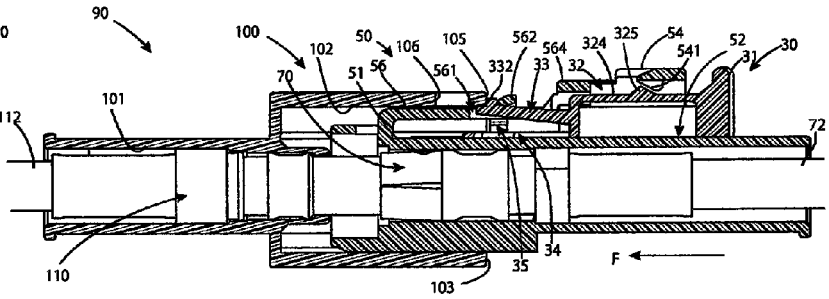
FIG. 10(B) is a sectional side view of the first connector and the second connector in the initial stage of mating.
Figure 10C:
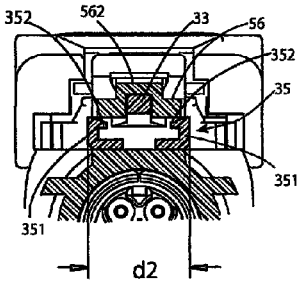
FIG. 10(C) is a detail sectional view taken along arrows E-E of FIG. 10(D)
Figure 10D:
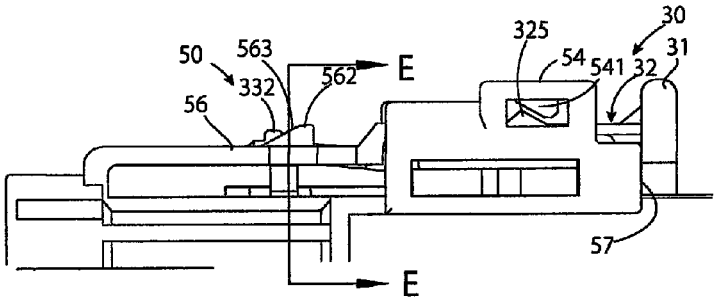
FIG. 10(D) is a top view of the initial stage of mating.

FIG. 10(B) is a cross-sectional view at the early stage of mating. In addition, FIG. 10(C) is a cross-sectional view taken along arrows E-E shown in FIG. 10(D). FIG. 10(D) is a top view at this early stage of mating. In FIG. 10(D), however, the second connector 90 is not shown in order to avoid complexity of illustration, and only a part of an upper portion of the first connector 10 is shown. The cross section indicated by the arrows E-E in FIG. 10(D) includes a cross section of the pressed-back portion 35 of the CPA 30.

It should be noted that the relative position of the CPA 30 with respect to the first housing 50 in FIGS. 11(A)-(C) and 12(A)-(C) described later is different from that in FIGS. 10(A)-10(D). In FIGS. 11(C) and 12(C) described later, however, a cross section in the same position as in FIG. 10(C) (a cross section including the pressed-back portion 35) is shown.

As shown in FIG. 10(C), a dimension between outer faces of the pair of hook portions 352 constituting the pressed-back portion 35 is denoted here by d2. Here, the width dimension d1 of the groove shown in FIG. 10(A) and the dimension d2 between the outer faces of the hook portions 352 are compared. FIGS. 10(A) and 10(C) are different in scale and therefore, in fact, despite their appearance, the relation d1>d2 holds true. Accordingly, when mating has advanced to a position in which the pressed-back portion 35 overlaps with the end face 103 shown in FIG. 10(A) of the second housing 100, the pressed-back portion 35 (the pair of hook portions 351) enters the groove 102. This, however, is a relation that holds true when the lock arm portion 56 keeps its original shape and is not depressed by the second housing 100.

Figure 11A:
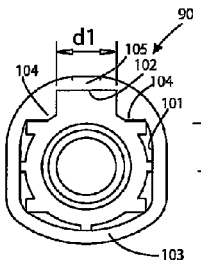
FIG. 11(A) is a front view of a front end face of the second housing in a state in which the mating has advanced from FIGS. 10(A)-10(D)
Figure 11B:
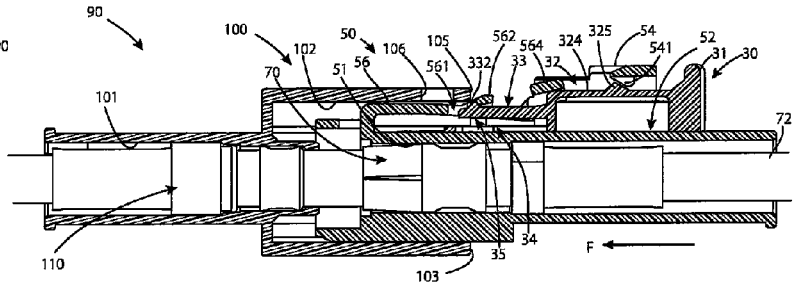
FIG. 11(B) is a sectional side view of the first connector and the second connector in the state of FIG. 11(A)
Figure 11C:
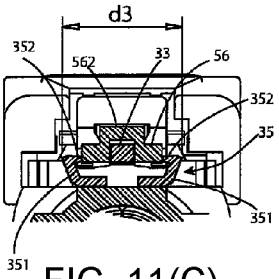
FIG. 11(C) is a detail sectional view taken along arrows E-E of FIG. 10(D) in the state of FIG. 11(A)
Figure 12C:
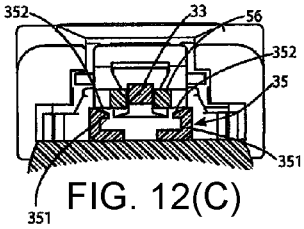
FIG. 12(C) is a detail sectional view of the first connector and the second connector in the completely mated state.

FIGS. 11(A)-11(C) are diagrams showing a state in which mating has advanced further from the state in 10(A)-10(D). FIGS. 11(A) to 11(C) correspond to FIGS. 10(A) to 10(C), respectively.

When mating has advanced to this stage shown in FIGS. 11(A)-11(C), the lock arm portion 56 is depressed by the second housing 100. Thereupon, the lock arm portion 56 depressed interferes with the projecting portions 352 of the pair of hook portions 351 and presses the projecting portions 352 apart, and the lock arm portion 56 gets in between the hook portions 351. When a maximum width between the hook portions 351 pressed apart is denoted by d3, d3>d1 holds true. Assume a situation where mating has advanced to the position in which, in such a pressed-apart state, the pressed-back portion 35 (the pair of hook portions 351) overlaps with the end face 103 shown in FIG. 11(A) of the second housing 100. In this case, the pressed-back portion 35 (the pair of hook portions 351) cannot enter the groove 102. Therefore, the pressed-back portion 35 (the pair of hook portions 351) hits against the pressing-back portion 104 on both sides of the groove 102 in the end face of the second housing 100, and the CPA 30 is blocked from moving further in the mating direction (the direction of the arrow F).

FIGS. 12(A)-12(C) show a state where mating has further advanced as compared with FIGS. 11(A)-11(C). As mating further advanced from the state shown in FIGS. 11(A)-11(C), mating proceeds to FIG. 12(A), and then to FIG. 12(B). That is, here, the pressed-back portion 35 (the pair of hook portions 351) hits against the pressing-back portion 104, and with the CPA 30 left in that position, the first housing 50 and the first contact module 70 advance in the mating direction (the direction of the arrow F). Until the state in FIG. 12(B) is reached, the lock arm portion 56 is depressed and elastically deformed by the second housing 100, and the pressed-back portion 35 (the pair of hook portions 351) is pressed apart.

When mating advances further from the state shown in FIG. 12(B), the abutting portion 562 of the lock arm portion 56 enters the lock hole 106 of the second housing 100. That is, the same state as FIG. 9(B) is reached. This means that the first connector 10 and the second connector 90 reaches a completely-mated state. In this state, as shown in FIG. 9(B), the CPA 30 has returned to the temporary caught position as a position relative to the first housing 150. However, the temporary locking projection 322 of the beam portion 33 of the CPA 30 has been depressed by the second housing 100, and the beam portion 33 has been elastically deformed.

On the other hand, though the beam portion 33 of the CPA 30 has been depressed, the abutting portion 562 has entered the lock hole 106, and elastic deformation of the lock arm portion 56 has been removed. That is, at the moment when transition from the state shown in FIG. 12(B) to the completely-mated state shown in FIG. 9(B) occurs, transition to the state shown in FIG. 12(C), namely, a state in which the interference that the pressed-back portion 35 (the pair of hook portions 351) has received from the lock arm portion 56 is removed, occurs. That is, the dimension d2 of the pressed-back portion 35 (the pair of hook portions 351) returns to the dimension smaller than the dimension d1 of the groove 102 of the second housing 100 (d1>d2). This enables the CPA 30 to slide to the caught position shown in FIG. 9(C) without being blocked by the second housing 100.

In this manner, according to the present embodiment, even if the CPA 30 has been moved to the caught position before mating starts, as shown in FIG. 6, mating is correctly performed. Due to the pressed-back portion 35, even if the CPA 30 is positioned in the caught position at the start of mating, the CPA is pressed back to the temporary caught position at the complete mating time. Then, the CPA 30 pressed back to the temporary caught position after complete mating is slid again to the caught position after complete mating. Thereby, the connectors 10, 90 are correctly mated even if the CPA 30 has moved to the caught position before mating, and furthermore, the CPA 30 assures that the connectors 10, 90 are completely mated. The pressed-back portion 35 advances into the path of the mating connector only when the lock arm portion 56 is pressed and elastically deformed by the mating connector 90. This achieves both avoidance of the CPA 30 obstructing a mating action if the CPA 30 is in the temporary caught position before mating, and pressing-back of the CPA 30 to the temporary caught position if the CPA 30 is in the caught position before mating.

Since the beam portion 33 that elastically deforms is provided, the movement between the abutted portion and the catching portion becomes smooth. On the other hand, since the beam portion 33 elastically deforms, the possibility that the CPA 30 may slide inadvertently to the caught position increases, but this point is compensated by the presence of the pressed-back portion 35.

It should be noted that, in the case of the present embodiment, the CPA 30 in the temporary caught position is restrained from sliding to the caught position at the two locations: the abutment of the abutting projection 332 against the abutting portion 562, and the interference of the projecting portion 325 with the downward-extending portion 541. In the case of the present embodiment, however, even if the CPA 30 has been moved to the caught position before mating starts, mating is correctly performed, and the CPA 30 can take the role of assuring that the connectors are completely mated. That is, a correct action is performed even if the projecting portion 325 or the downward-extending portion 541 is not provided, and therefore these elements are not necessarily required. By providing the projecting portion 325 and/or the downward-extending portion 541 and making them interfere with each other, however, the possibility that the CPA 30 has moved to the caught position before mating starts can be significantly reduced.

Moreover, by making them interfere with each other, a click feel is given according to sliding to the caught position.

What is claimed is:

1. A connector, comprising:

a housing; and a connector position assurance device positioned in a temporary caught position on the housing when the connector is not mated with a mating connector, the connector position assurance device allowed to slide to a caught position in front of the temporary caught position in a mating direction when the connector is completely mated with the mating connector, the connector position assurance device assuring that the connector is completely mated with the mating connector in the caught position, the connector position assurance device has a pressed-back portion abutted by the mating connector during mating and pressed back relative to the housing if the connector position assurance device is positioned in the caught position when the connector starts to mate with the mating connector, positioning the connector position assurance device in the temporary caught position at a complete mating of the connector with the mating connector.

2. The connector of claim 1, wherein the connector position assurance device has a base portion and a beam portion projecting forward in the mating direction from the base portion.

3. The connector of claim 2, wherein the housing has a lock arm portion extending in a cantilever shape from front to rear in the mating direction, the lock arm portion abutting against the beam portion in the temporary caught position and blocking the connector position assurance device from moving from the temporary caught position.

4. The connector of claim 3, wherein the lock arm portion is pressed and elastically deformed by the mating connector to remove abutment with the beam portion during mating of the connector with the mating connector, allowing the connector position assurance device to move to the caught position.

5. The connector of claim 4, wherein the pressed-back portion interferes with the lock arm portion pressed and elastically deformed by the mating connector during mating and advances into a path of the mating connector with respect to the mating direction.

6. The connector of claim 5, wherein, if the connector position assurance device is positioned in the caught position at a start of mating with the mating connector, the pressed-back portion abuts the mating connector and is pressed back relative to the housing as mating advances, positioning the connector position assurance device in the temporary caught position at the complete mating.

7. The connector of claim 3, wherein the connector position assurance device has an arm portion extending forward in the mating direction from the base portion.

8. The connector of claim 7, wherein the pressed-back portion is formed on the arm portion.

9. The connector of claim 8, wherein the arm portion has a pair of extending portions extending forward in the mating direction from the base portion with a gap between the extending portions, and a connecting portion connecting a pair of distal end portions of the extending portions.

10. The connector of claim 9, wherein the pressed-back portion has a pair of hook portions formed individually on each of the extending portions, rising toward the lock arm portion with a gap between the hook portions, the hook portions have a pair of projecting portions projecting toward each other at distal end portions of the hook portions.

11. The connector of claim 10, wherein the lock arm portion pressed and elastically deformed by the mating connector during mating interferes with the projecting portions and presses the pair of hook portions apart, and thereby the pressed-back portion advances into the path of the mating connector with respect to the mating direction.

12. The connector of claim 9, wherein the lock arm portion has an abutting portion abutted by the beam portion when the connector position assurance device is in the temporary caught position, and the lock arm portion has a catching portion formed in front of the abutting portion in the mating direction and catching the beam portion when the connector position assurance device is in the caught position.

13. The connector of claim 12, wherein the beam portion moves while elastically deforming from one of a state of abutting against the abutting portion and a state of being caught by the catching portion to the other.

14. The connector of claim 13, wherein the gap formed between the two extending portions has a width for receiving the beam portion elastically deformed.

15. A connector assembly, comprising:

a first connector having a first housing and a connector position assurance device; and a second connector having a second housing, the connector position assurance device positioned in a temporary caught position on the first housing when the first connector is not mated with a second connector, the connector position assurance device allowed to slide to a caught position in front of the temporary caught position in a mating direction when the first connector is completely mated with the second connector, the connector position assurance device assuring that the first connector is completely mated with the second connector in the caught position, the connector position assurance device has a pressed-back portion abutted by the second housing during mating and pressed back relative to the first housing if the connector position assurance device is positioned in the caught position when the first connector starts to mate with the second connector, positioning the connector position assurance device in the temporary caught position at a complete mating of the first connector with the second connector, the second housing has a pressing-back portion abutting against the pressed-back portion of the connector position assurance device positioned in the caught position at a start of mating and pressing back the connector position assurance device relative to the first housing until the connector position assurance device is positioned in the temporary caught position at the complete mating.

16. The connector assembly of claim 15, wherein the connector position assurance device has a base portion and a beam portion projecting forward in the mating direction from the base portion.

17. The connector assembly of claim 16, wherein the first housing has a lock arm portion extending in a cantilever shape from front to rear in the mating direction, the lock arm portion abutting against the beam portion of the connector position assurance device in the temporary caught position and blocking the connector position assurance device from moving to the caught position, the lock arm portion is pressed and elastically deformed by the second housing during mating to remove abutment against the beam portion, allowing the connector position assurance device to move to the caught position.

18. The connector assembly of claim 17, wherein the pressed-back portion interferes with the lock arm portion pressed and elastically deformed by the second housing during mating and advances into a path of the pressing-back portion with respect to the mating direction, and if the connector position assurance device is positioned in the caught position at the start of mating, the pressing-back portion abuts, with advance of mating, against the pressed-back portion interfering with the lock arm portion elastically deformed and advancing into the path of the pressing-back portion, and presses back the connector position assurance device relative to the first housing until the connector position assurance device is positioned in the temporary caught position at the complete mating.

19. The connector assembly of claim 18, wherein the second housing has a groove portion for receiving the lock arm portion at the complete mating, the pressing-back portion is formed on a pair of sides across the groove portion, and the connector position assurance device has an arm portion having a pair of extending portions extending forward in the mating direction from the base portion with a gap between the extending portions and a connecting portion connecting a pair of distal ends of the extending portions together.

20. The connector assembly of claim 19, wherein the pressed-back portion has a pair of hook portions formed individually on the extending portions, rising toward the lock arm portion with a gap between the hook portions, and having a pair of projecting portions projecting toward each other at distal end portions of the hook portions, and the lock arm portion pressed and elastically deformed by the second housing during mating interferes with the projecting portions and presses the pair of hook portions apart, and thereby the pressed-back portion advances into respective paths of the pressing-back portions with respect to the mating direction.

* * * * *